United States Patent [19]

Sheldon

[11] 4,104,647

[45] Aug. 1, 1978

[54] APPARATUS WITH TWO VACUUM CHAMBERS FOR ELECTROPHOTOGRAPHY PRODUCING IMAGE BY ELECTRICAL CHARGES

[76] Inventor: Edward Emanuel Sheldon, 30 E. 40 St., New York, N.Y. 10016

[21] Appl. No.: 754,405

[22] Filed: Dec. 27, 1976

[51] Int. Cl.[2] ..... G03G 15/044

[52] U.S. Cl. ..... 346/158; 313/420

[58] Field of Search ..... 346/158, 161, 136; 358/300; 313/420

[56] References Cited

U.S. PATENT DOCUMENTS

| | | | |
|---|---|---|---|
| 2,839,602 | 6/1958 | Fries | 313/420 |
| 3,188,650 | 6/1965 | Schröter | 346/158 |
| 3,234,561 | 2/1966 | Stone | 346/158 |
| 3,319,318 | 5/1967 | Taimuty | 313/420 |
| 3,447,021 | 5/1969 | Engel | 346/158 |
| 3,504,371 | 3/1970 | Reed, Jr. | 346/158 |
| 3,611,005 | 10/1971 | Uno | 313/420 |
| 3,611,418 | 10/1971 | Uno | 313/420 |
| 4,005,438 | 1/1977 | Meltzer | 346/158 |

FOREIGN PATENT DOCUMENTS

| | | | |
|---|---|---|---|
| 981,873 | 1/1965 | United Kingdom | 346/158 |

*Primary Examiner*—Jay P. Lucas

[57] ABSTRACT

This invention relates to the novel system of electrophotography. The image of examined object is converted in a novel vacuum tube into a beam of electrons. The beam of electrons is converted next into an electrical or light pattern and is stored on a movable sheet of dielectric material which travels through said vacuum tube. Means are provided for introducing said sheet or tape of dielectric material into said vacuum tube and for transporting it after the exposure to the outside of said vacuum tube. It was found that continuous introduction of a movable sheet of said dielectric material into the vacuum tube causes an irreparable damage to the photocathode of said tube. This problem was solved by the use of a membrane which transmits said beam of electrons and which separates effectively the vacuum compartment of said tube in which the photocathode is located from the rest of said tube.

20 Claims, 14 Drawing Figures

FIG. 2A
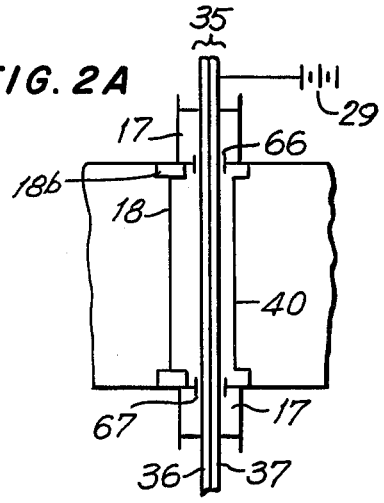
FIG. 4
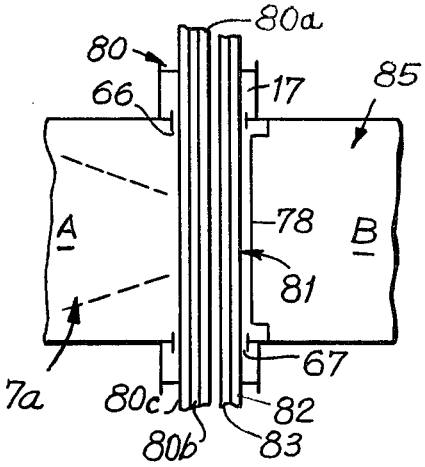
FIG. 4A
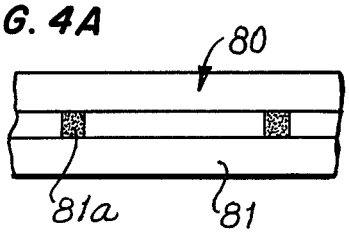
FIG. 4B
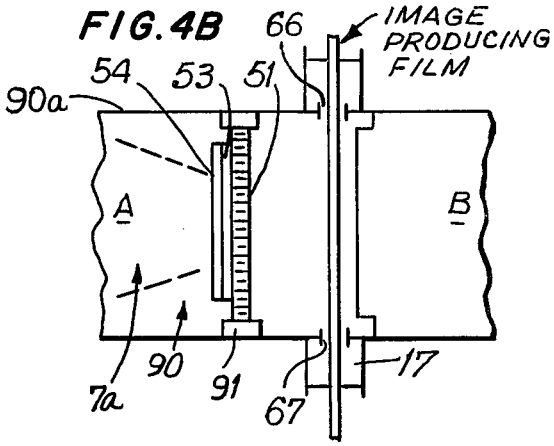
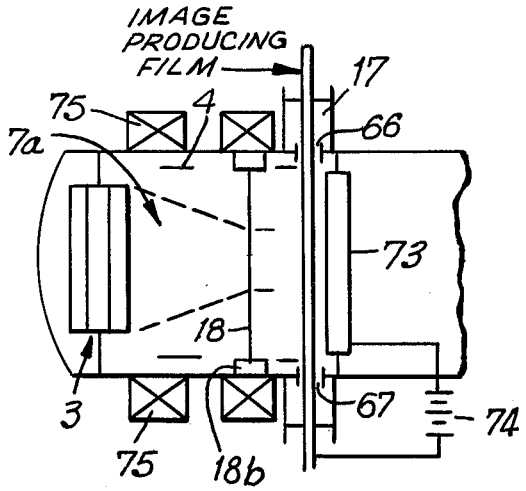
FIG. 5
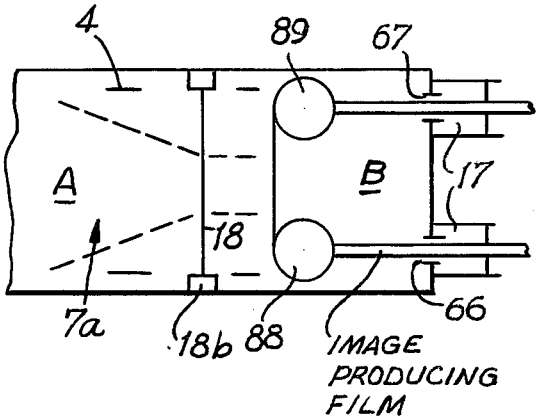
FIG. 6

APPARATUS WITH TWO VACUUM CHAMBERS FOR ELECTROPHOTOGRAPHY PRODUCING IMAGE BY ELECTRICAL CHARGES

This invention relates to a novel system of electrophotography which means an apparatus for producing pictures formed by electro-magnetic radiations, such as X-rays, Gamma rays, infrared rays or by atomic particles beams such as electrons or neutrons.

The present systems are based on the use of films made with silver halides and which are used in combination with X-ray sensitive fluorescent screens. The present radiographic systems do not provide any means for intensification of the X-ray image and as a result a large amount of X-radiation is necessary to produce a radiograph. This may be not of crucial importance in industrial radiography, but is of great importance in the medical radiography in which the X-ray exposure of patients should be kept at minimum. In view of the fact that the number of X-ray examinations increases greatly every year, the concern is voiced that many patients, especially of reproductive age receive too large amount of X-radiation which may affect their genetic system. This means that the number of congenital malformations in new-born may increase greatly. It is therefore of great importance to provide a system of radiography which will reduce the X-ray exposure of patients and still will provide the necessary diagnostic information. This is the main objective of the present invention.

Another objective of this invention is to produce X-ray images, and images formed by other electromagnetic radiations and by atomic particles beams, of better diagnostic quality than it was possible using the present methods.

The above objectives were realized by the novel system of electroradiography which is characterized by the use of electronic amplification of images in a novel vacuum tube, of inexpensive materials such plastics for reproducing images in a visible form as electroradiographs, and a system of continuous feeding said image reproducing film or tape into said vacuum tube for exposure and transporting said film to the outside of said tube for inspection of the image. It was found, however, that this system produced impairment of the vacuum of the novel vacuum tube 1 and resulted into an early decay of the photocathode or of the electron gun mounted in said tube. This problem was solved by the use of a continuous very thin membrane mounted in the path of the electron beam *7a* which is emitted by the photocathode 3 or its modifications and which beam carries the image of the examined object or body.

The invention will be better understood when taken together with the accompanying drawings.

Figure 1:
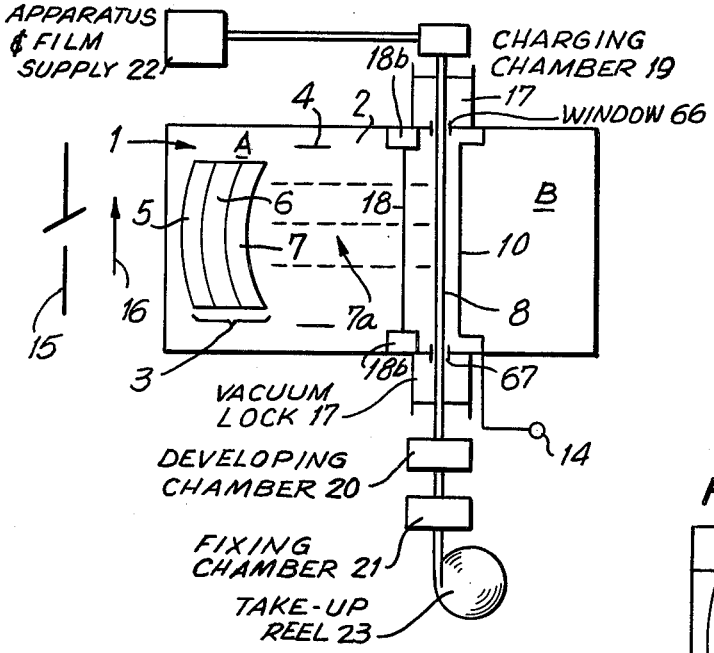
FIG. 1 shows the new apparatus for electroradiography which comprises an X-ray or gamma rays sensitive vacuum tube, comprising dielectric film travelling through said tube and a separating membrane.
Figure 1A:
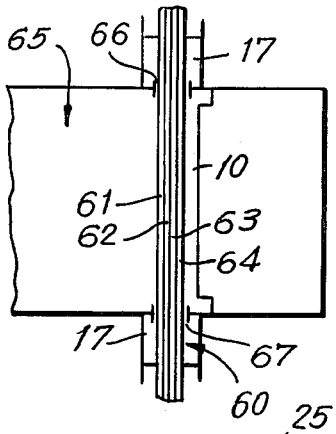
FIG. 1A shows modification in which a film comprising in combination a fluorescent layer and a photo-conductive layer is used in a vacuum tube.
Figure 1A:
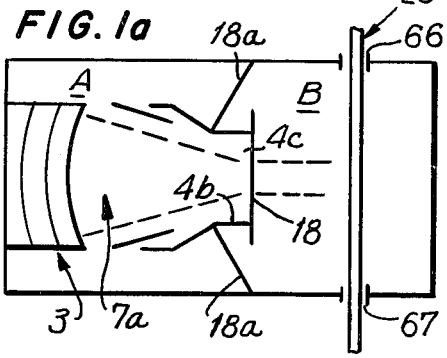

FIG. 1*a* shows modification of electron beam transmitting membrane or screen.

Figure 1B:
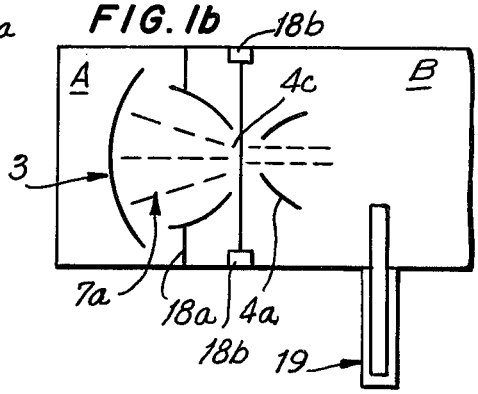

FIG. 1*b* shows modification of vacuum tube which is provided with a shutter.

Figure 1C:
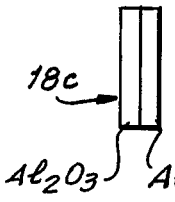

FIG. 1*c* shows modification of electron beam transmitting membrane.

Figure 1D:
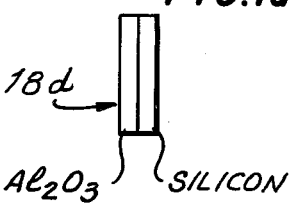

FIG. 1*d* shows modification of electron beam transmitting membrane.

Figure 2:
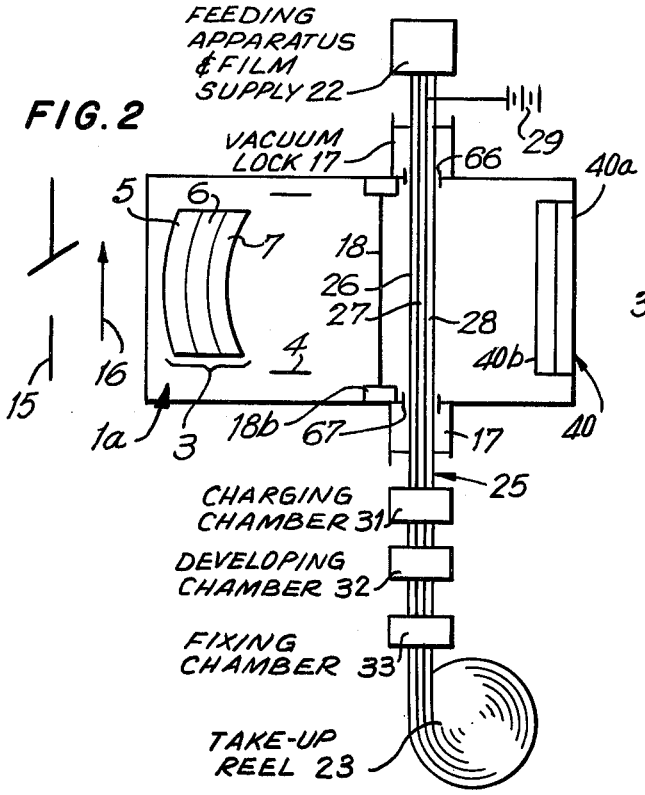

FIG. 2 shows modification of the apparatus for electrophotography in which the novel vacuum tube contains a layer of material which exhibits electron bombardment induced conductivity, said layer movable through said tube.

FIG. 2A shows modification of the layer used in the embodiment of FIG. 2.

Figure 3:
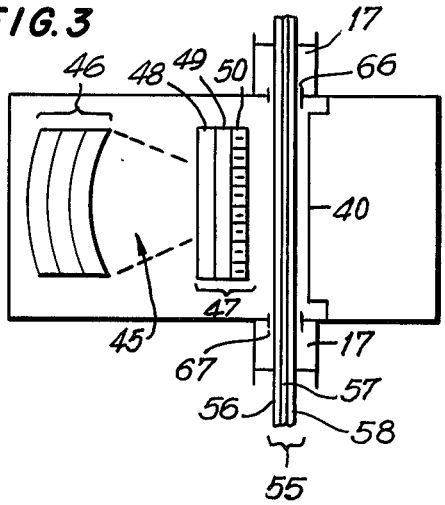

FIG 3 shows modification of the apparatus for electrophotography in which a film comprising a layer of photoconductive material is used in a vacuum tube.

FIG. 4 shows embodiment of invention in which image producing means comprise a travelling fluorescent screen in combination with a travelling light sensitive film.

FIG. 4A shows assembly of fluorescent screen with light sensitive film.

FIG. 4B shows embodiment of invention in which fluorescent means are stationary and image producing means are travelling across the vacuum tube.

FIG. 5 shows embodiment of invention in which magnetic or electro-magnetic electrodes are used.

FIG. 6 shows modification of the compartment for transporting image producing film.

FIG. 1 shows the X-ray or gamma ray or neutrons source 15, the examined object 16 and the novel X-ray or gamma rays or neutrons sensitive image tube 1 which comprises an evacuated envelope 2. The X-ray or gamma rays or neutrons sensitive photocathode or screen 3 may be mounted on the inside surface of the endwall of said tube or it may be mounted in a spaced apart relationship from said endwall. In the latter case it will be supported by the supporting member 5 such as of aluminum or beryllium. The photocathode 3 comprises furthermore fluorescent layer 6 of one of phosphors such as of CsI or ZnSCdS or $CaWO_4$ or of mixture thereof and photoemissive layer 7 such as of CsSb or K-Cs-Sb, Na-K-Sb or other photoelectric materials of multi-alkali type. The X-ray image is converted in said photocathode 3 into a fluorescent image and next into a beam of free photoelectrons *7a* corresponding to the X-ray image. The beam of photoelectrons *7a* is accelerated to the necessary velocity by electrostatic electrodes and then is focused by electrostatic or magnetic focusing electrode means 4 onto electron reactive dielectric film 8. The focusing means 4 may be also of demagnifying type which will reduce the size of electron beam *7a* by factor of 2 to 10 according to the size of the tube 1 and resolution of image desired. The demagnifying focusing means 4*a* may be in the form of electrostatic cylinders or rings of progressively decreasing diameter or may be in the form of two spherical cones 4*b* and 4*c* as it is well known in the Art. The accelerating electrodes may increase the velocity of the electron beam *7a* to 12 – 30 KV or higher according to the application. In some cases the focusing electrodes may be omitted and photoelectron or electron beam may be focused onto film 8 by proximity focusing. In such case the spacing between the photocathode 3 and film 8 should not exceed 2mm and the photocathode 3 will have a planar shape. The electron reactive film 8 may be one of flexible or semi-flexible plastics of a high electrical resistivity such as polyesters, polyamides, polyethylenes or polycarbonates. Preferably a transparent material should be used, but this is not obligatory.

In the embodiment of invention which uses electrostatic focusing means the film 8 or its modifications described below may have a curvature with the concavity facing the concavity of the photo-emissive layer or it may be also of planar shape. In the embodiment in which magnetic focusing means are used and also in modification in which the proximity focusing is used the film 8 will have planar shape parallel to the planar shape of the photo-emissive layer.

The dielectric film 8, in some applications receives in a charging chamber 19 before its introduction into the X-ray sensitive vacuum tube 1 an electrostatic uniform charge of positive sign on its surface which will face the photocathode 3. The dielectric film 8 positively pre-charged will be now introduced into vacuum tube 1 through the window 66 protected by vacuum locks 17 and will be bombarded by the electron beam *7a*. In this modification the velocity of photo-electron beam must be such that it produces secondary electron emission of less than unity and forms thereby a negative charge image on film 8. This negative charge image is immediately neutralized by the positive electrostatic charge which was deposited on film 8 previously. As a result the remaining positive charge on film 8 will have the pattern of the original photo-electron beam and therefore of the original X-ray image. The film 8 is now transported out of the vacuum tube 1 through window 67 protected by vacuum locks 17 and travels into developing chamber 20 which may have various forms well known in the Art and which may use a toner for said development. The film 8 with the developed image is transported now into transfer and fixation chamber 21 to produce the permanent image. If the transfer of image on to another material is desired, it can be done by well-known transfer techniques. The final image may be therefore in the form of transparency and can be examined with transmitted light like any conventional X-ray film, or it may be in non-transparent form in which case it will be examined with reflected light.

The apparatus 22 for feeding and transporting the film 8 or its modifications into the vacuum tube 1 through window 66 and apparatus 23 transporting said film 8 to the outside of said vacuum tube are of standard type.

In another modification of invention the film 8 is charged uniformly with electrostatic charge of negative sign. In this embodiment the photo-electron beam is accelerated to velocity in which the secondary electron emission is higher than unity. The secondary electrons are led away by the mesh screen. As a result, the positive charge is formed on film 8 and it is neutralized by the negative electrostatic charge deposited previously. In this way the remaining negative charge will have the pattern of the original photo-electron beam which again had the pattern of the original X-ray image, gamma or other electromagnetic radiation or atomic particles image. The rest of developing and fixing and transfer procedures is the same as was described above.

It should be understood that in many applications film 8 may be used without pre-charging it with electrostatic charge as was described above. In such case the electrostatic charge will be applied to film 8 in the developing chamber 20.

It was found that the continuous introduction of the film 8 or modifications described below into vacuum tube 1 caused deterioration of the vacuum of said tube and leads to premature inactivation of the photo-emissive layer 7. This necessitates replacement of the photocathode 3 or in many cases of the entire vacuum tube. The solution of this problem was found in the construction of the vacuum tube 1 in which a very thin membrane 18 was mounted in the path of the electron beam *7a*. The membrane 18 may be also called a screen, is continuous, which means imperforate, and is mounted on a support 18*b* so that this support together with said membrane occlude the lumen of the vacuum tube 1 and create thereby two separate vacuum compartments, namely compartment A in which photocathode 3 or its modifications is located and vacuum compartment B in which image producing means such as film 8 or 25 or 55 and their modifications are located. The membrane 18 may be of dielectric material such as aluminum oxide or silicon oxide or dioxide or it may be of an electrically conducting layer such as of silicon or aluminum which is mounted on the supporting layer of dielectric material such as described above. This is illustrated in FIG. 1*c* and 1*d*. The main characteristic of the membrane 18 and its modifications is that it is transmitting electrons of velocity higher than 2KV and is not transmitting to ions, of velocity up to 30KV. The thickness of membrane 18 and its modifications will depend on the velocity of the electron beam 7. It should be understood that membrane 18 and its modifications may be mounted in various positions. One preferred position for the membrane 18 to be mounted is on the aperture 4*c* of demagnifying electrode 4*a* or 4*b* or in its vicinity as shown in FIG. 1*a* and 1B. In such case, additional mechanical members such as baffles or flanges 18*a* must be provided to effect the complete closing of vacuum compartment A and its separation from compartment B.

The membrane 18 and its modifications may be also placed after the aperture 4*c* of the electrode and will be then supported by supporting means 18*b*, which may be attached to walls of the tube 1 as shown in FIG. 1 or to walls of electrodes 4 or 4*a* or 4*b*. It should be understood that membranes 18 or its modifications may be also mounted within electrodes 4 or electrode of demagnifying type 4*a* or 4*b*, which means before the aperture 4*c*.

The complete separation of vacuum compartment A from vacuum compartment B will insure that the impairment of vacuum in the compartment B by continuous introduction of the film 8 or film 25 or 35 or 55 will have no effect on the compartment A and on the photo-emissive 7 layer anymore.

It should be understood the use of membrane 18 and its modifications applies also to all vacuum tubes provided with electrodes of magnetic or electro-magnetic type.

It was found that membrane 18 being very thin was easily ruptured if the pressure in compartment B fluctuated widely. Such changes of pressure may be reduced to a minimum compatible with the integrity of membrane 18 by an efficient system of vacuum locks 17. It was found, however, that in some cases it is necessary to provide a further protection and this was obtained by the use of shutter 19 which is shown in FIG. 1*b*.

The shutter 19 is closed when the film 8 or 25 or 35 or modifications enters into compartment B and it opens synchronously with the X-ray exposure by gamma rays or other electromagnetic radiations, such as infrared, and also applies to the exposure by a beam of atomic particles, such as electrons or neutrons. The shutter 19 closes after each exposure. Therefore, the fluctuation of pressure in compartment B due to opening of vacuum locks 17 will have no effect on membrane 18 and its modifications.

It was also found unexpectdly that the use of closing membrane 18 and its modifications reduced the background dark current of vacuum compartment A. This is of a great importance in applications in which the imaging signals input is so weak that it approaches the level of the background noise of compartment A. In such cases the use of closing membrane 18 and its modifications was found to increase considerably the signal to noise ratio of this device and will provide useful images which would be otherwise lost in the noise of the tube. This is of great importance for construction of Gamma Cameras.

It should be understood that this invention is applicable and useful also for vacuum tubes which do not use a traveling film such as 8 or 25 or modifications across the tube as was described above, and which comprise instead of this film 8 or 25 or 35 or modifications, a screen comprising a fluorescent layer or other electron reactive layer to produce an image and which is permanently mounted in the tube.

It should also be understood that this invention is applicable and useful for vacuum tubes which are responsive to infrared. In such cases the photocathode 3 may be modified to eliminate the fluorescent layer 6 and the supporting layer of aluminum, and the photo-emissive layer 7 may be of caesium oxide or of photo-emissive materials which have negative electron afinity such as gallium arsenide or silicon of p type or n type conductivity.

It was found, however, that in some applications such as in medical radiography where the imaging X-radiation has to be very low in order not to harm patients, the above described devices do not have the sensitivity which is necessary. It was found that in examinations of heavy parts of patients, such as abdomen, it is necessary to improve the sensitivity by a factor of 100–200. In order to obtain such improvement, it is necessary to increase the current density of the photo-electron beam without increasing the amount of X-radiation. This was accomplished by using cascade intensification in which another composite screen made of a light reflecting layer, a fluorescent layer, a light transporting member and of a photo-emissive layer in that order is mounted in spaced relation to the photocathode 3. The photo-electron beam from photocathode 3 is accelerated to 15–20 KV before it impinges on the second composite screen producing thereby intensification of photo-electron beam by a factor of 50–100 as it was described in my U.S. Pat. No. 2,555,423. It may be added that the supporting light transparent layer for the second composite screen may be of vacuum resistant plastic material, such as polyamide or silicone in order to be able to make this second composite screen of size necessary in medical radiography. In some cases the fluorescent layer may be mixed with a light transparent separating layer to make a self-supporting member of this mixture.

This construction will give intensification by factor 50 which will be still insufficient for X-ray examinations of heavy parts. The sensitivity should be improved by an additional factor of 2 to 3. This was accomplished by coating the surface of dielectric film 8 which is exposed to the primary beam of photoelectrons or electrons from the X-ray reactive screen 3 with a layer of good secondary electron emitter such as MgO or an alkali halide. A good secondary electron emitter means material which emits more of secondary electrons than the dielectric film 8. For example, secondary electron emission of plastics is limited to 2 secondary electrons for one primary electron, whereas MgO will emit 4–5 secondary electrons for one primary electron. The layer of good electron emitter may be a continuous layer if the said material is insulator or should be of mosaic type if said material is of semi-conducting or conducting type.

Another way to amplify the photo-electron beam is to use a multi-channel electron multiplier as described in my U.S. Pat. No. 3,400,291.

Another way to amplify the photo-electron beam is by the use of an electron multiplier of transmission type, such as a membrane of silicon preferably of p-type.

All these amplifying means will increase the sensitivity of this apparatus for radiography by a factor of 100–200. The above described amplification allows to use the very low sensitivity dielectric film 8 without increasing the amount of X-radiation and such combination represents an important feature of this invention.

In all embodiments of invention it is advantageous for better sensitivity to demagnify the photo-electron beam electronoptically. This is also of great importance as it permits to reduce the size of the amplifying stage which will allow to make the apparatus of a smaller size and of a lower cost.

In some applications it is preferable to provide amplification of the photo-electron beam by other means than described above, which are technologically complicated. FIG. 2 shows a simplified and efficient solution to the problem of increasing sensitivity of vacuum tube 1 and of the system of Radiography. In this embodiment of invention the film 8 is replaced with the composite film 25, which comprises a layer of dielectric material 26 which when being bombarded by electrons or photoelectrons produces electrical conductivity changes. Such layer may be of MgO, alkali halides, ZnS or CdS or $Sb_2S_3$ with activators such as Tellurium or Arsenic. Next to layer 26 is layer of electrically conducting material 27 which may be of transparent type such as Nesa or indium oxide or of non-transparent material, such as of a metal like Al or Cu. Next to layer 27 is the support layer 28 which may be of any flexible material, such as of plastics, e.g. polyesters, polyamides or polycarbonates. The layer 27 is connected to a suitable source of electrical potential 29 or to a ground. The rest of vacuum tube **1*a* will have a similar construction as the tube 1 shown in FIG. 1 or in 1-A or in 1-B or in 1*a* or in 1*b***.

In some applications the vacuum tube **1*a* is provided with a fluorescent screen 40 mounted on the endwall of the tube or on a separate support spaced apart from said endwall. The fluorescent screen comprises a fluorescent layer 40*a* and an electron transmitting light reflecting layer 40*b*, such as of aluminum. The fluorescent screen 40** may have various modifications which are well known in the Art.

The photo-electron beam from the photocathode 3 is accelerated to 10–20 KV velocity and when it impinges on layer 26 it produces therein a pattern of electrical conductivity changes which corresponds to the original X-ray/or other radiation image. This pattern of electrical conductivity will persist in a suitable material for a long time. The film 25 will be now transportd to the charging chamber 31 in which an electrostatic uniform charge will be deposited on the free surface of layer 26. This charge will leak away due to electrical conductivity induced in layer 26 and the remaining charge will have now the pattern of the original X-ray image. Next the film 25 is transported into developing chamber 32 in which a suitable toner is applied to make this charge visible. Next the film 25 is transported to chamber 33 in which it is transferred to another film and after the transfer it is fixed to produce a permanent image. The new transfer material may be preferably of transparent type such as of acetate, polyester, polycarbon or polyamide. The film 25 after cleaning and neutralization of charges will be recycled for the next exposure. In this way the new device provides an inexpensive system of radiography in which a cheap plastic film will replace expensive X-ray films.

FIG. 2-A shows another embodiment of the film 25 in which only 2 layers are present. The film 35 consists of layer 36 whichis of dielectric material such as MgO, alkali halides, ZnS or CdS or $Sb_2S_3$ with activators such as Tellurium or Arsenic, and exhibits electron bombardment induced conductivity. Next is the layer 37 which is of flexible and electrically conducting material, such as copper laminate or other metal laminate and which is made thick enough to be self-supporting. The layer 37 is connected to the source of electrical potential 29 or to ground. The planar or curved member 40 may be used to provide support for the film 25 or 35. It may also serve to provide the necessary curvature for the film 25 or 35 in some cases. It may be also connected to the source of electrical potential to provide high acceleration for the electron beam, such as 10–20 KV, which is necessary to produce electrical conductivity by electron bombardment. The member 40 may be conversely connected to the ground, if the photocathode is held at high negative potential.

In some applications the film 25 or 35 may be precharged with a uniform electrostatic charge before introducing said film into vacuum tube 1 or its modifications. In such case its subsequent deposition of electrical charge after removal of film 25 or 35 from vacuum tube may be omitted. This embodiment of invention is of importance if the materials used for film 25 or 35 exhibit induced electrical conductivity for a short time only. The electron bombardment induced conductivity can produce amplification of the electron beam by the factor of 100 to 1000 and allows therefore to eliminate other amplification means described above, in some applications. In other cases however there may be need for additional amplification of the electron beam and in such cases the use may be made of all amplifying devices which were described above. In particular, it should be understood that in all devices described above the use may be made of amplification of the electron beam either by means of another stage composite screen, or of a multi-channel electron multiplier or of transmission type of electron multiplier such as silicon membrane of p-type. It should be understood that in all devices described above, the focusing means for electron beam may be of electrostatic type or of magnetic type or of proximity focusing type.

It should be understood that in all embodiments of invention, the final radiographic image may be made on a transparent substrate or on light reflecting substrate. It should be understood that in all embodiments of invention the final radiograph may be made of either polarity which means that black and white areas of radiograph may be reversed according to the need of application. It should be understood that in all embodiments of invention the final radiograph may be produced on the original film which was used in a vacuum tube 1 or its modifications or may be produced on another film which serves as a transfer medium.

In conclusion, an efficient and inexpensive new system of electroradiography is provided by the apparatus described in FIG. 2 and 2-A and their modifications, which will provide at the same time better X-ray examinations and at a much lower cost.

FIG. 3 shows another embodiment of invention which will be useful in some applications. In this embodiment the vacuum tube 45 comprises X-ray reactive screen 46 of one of modifications described above and in addition a composite fluorescent screen 47. Screen 47 comprises light reflecting layer which is pervious to electrons, e.g. of aluminum 48, fluorescent layer 49 of one of phosphors described above and a light transparent supporting layer 50 of one of plastics such as polyesters or polyamides or silicones. The layer 50 may also be in the form of a fiberoptic member which is constituted of an array of light conducting fibers. Each of said light conducting fibers conducts light by internal reflection and comprises core of transparent material of a high index of refraction such as glass, quartz or suitable plastics such as polycarbonates or acrylates. Each of said fibers has a coating of material of a lower index of refraction. The coating may be only of a few microns thickness. The plurality of such fibers assembled together forms an array which can conduct the image by internal reflection from one end of said array to the other end of said array. The X-ray or other radiation image is converted into an electron beam which represents the original X-ray image. This electron beam is demagnified by electron-optical means and is accelerated to high energy such as 20KV to excite the fluorescent layer 49 and to produce fluorescent image corresponding to X-ray image. The fluorescent image is conducted by the supporting member 50 and irradiates the image producing film 55. In some cases the electron beam is not demagnified, but is of original size. This is the case when proximity focusing is used.

The image reproducing film 55 has different construction from the film 25 or 35 because the first layer which receives the fluorescent image is the layer 56 which is of dielectric material and which has also photo-conductive properties. Such materials are Se, Zns and CdS and $Sb_2S_3$ with suitable activators such as As or Te. The next layer 57 is electrically conducting material and may be of light transparent type such as Nesa or indium oxide or of light non-transparent material such as a metal. The next layer 58 is a supporting member which is of flexible and dielectric material and which may be of light transparent type or of light impervious type. Materials such as plastics described above or fiberglass or laminates of glass may be used for layer 58. The film 55 may be also simplified to consist of two layers only. In this embodiment the electrically conducting layer 57 is made thick enough to serve as a supporting layer and is constructed to be flexible. It may be therefore made of laminates of metals such as copper or other metals which provides the necessary flexibility. The electrically conducting layer 57 may be connected to the source of electrical potential or to ground. The film 55 is mounted in a very close spacing to the supporting member 50, such as not exceeding 100 microns. In cases in which the supporting member 50 is made of fiberoptic plate described above, film 55 may be in contact with the member 50. The supporting member 50 may be of planar shape or of curved shape according to the electron-optical system used. In cases in which the supporting member 50 is of plastic, the film 55 may be self-supporting or may rest on the support in the form of separate member 40 as was shown in FIG. 1 and 2. The photoconductive layer 56 of film 55 when exposed to the fluorescent image from the layer 49 responds with changes of its electrical conductivity which have the pattern of said fluorescent image. This photo-conductivity pattern will persist in a photo-conductor material of storage type for a long time. Materials such as $Sb_2S_3$ with activators such as As and Te have very good storage properties. The film 55 may be now transported through vacuum safety locks 17 to the outside of vacuum tube 45 into charging chamber 31 in which it receives a uniform electrostatic charge as described above. The electrostatic charge leaks away through the areas which were made electrically conductive by fluorescent image. The remaining charge will be the replica of the original fluorescent image. The film 55 is now transported to the developing chamber 32 in which a toner in the form of one of black powders is applied to visualize the pattern of electrostatic charges. Next the film 55 is transported to the transfer chamber 33 where the electrical charge with toner is transferred to the final supporting sheet which may be of light transparent or light impervious material and is fixed therein as was described above.

Another embodiment of invention vacuum tube 65 is shown in FIG. 1A. In this embodiment the photocathode, the focusing, accelerating and demagnifying electrodes system, separating membrane, shutters, vacuum locks, charging chambers, developing chamber, may be of any type described above. The difference resides in the construction of image producing film 60 which comprises fluorescent layer 61, light transparent supporting layer 62 such as of aluminum oxide or of silicon oxide or of polyester, polyamides, or polycarbonates, a light transparent conducting layer 63 which may be of tin oxide, known also under trade name of Nesa and manufactured by Pittsburgh Plate Glass Company, and a photoconductive layer 64 of any materials described above for the layer 56. The electron beam image **7*a* representing the original X-ray image, or other radiations as explained above, strikes fluorescent layer 61 and produces fluorescent image. The fluorescent image is transmitted through very thin light transparent supporting layer 62 and conducting layer 63 and activates photoconductive layer 64 and produces therein pattern of electrical conductivity changes corresponding to said fluorescent image. The layer 64 may be precharged before introducing it into vacuum tube 65 or it may be also charged after its removal from the tube 65. The rest of operation is the same as described for operation of vacuum tube 45** above.

It should be understood that image producing means such as 8 or 25 or 35 and other modifications may be also in the form of dry silver film mounted on a suitable base such as of polyester. This dry silver film is manufactured by 3M Company and the most sensitive film of this type is identified by No. 7859. This film after the exposure to electron beam can be developed outside of the vacuum tube by heating and has good resolution and contrast.

As was explained above, novel vacuum tubes for electrophotography provide a large intensification of the original image because of electron acceleration and because of electron-optical demagnification. This great intensification permits the use of electron sensitive film, such as of silver halide or other halides with good resolution and contrast. At the same time an electronoptical demagnification allows to reduce the size of standard X-ray film by factor of 3 to 10 which results in a great saving in expenses. The film for this operation must be very flexible, which can be accomplished by using a thin base of polyester or other light transparent plastics for electron sensitive emulsion. If the sensitivity of this film has to be increased, a light sensitive film 81 comprising silver halide or other halides may be used in combination with a film 80 which comprises fluorescent layer **80*b* of phosphors, such as of calcium tungstate or of phosphors activated with rare earth elements such as terbium or with gadolinium or of evaporated CsI. This embodiment of invention, the vacuum tube 85 is shown in FIG. 4 in which electron beam 7*a* impinges on the fluorescent screen 80 and the light from the fluorescent screen activates the emulsion of the light sensitive film 81. The fluorescent layer 80*b* is provided with a light reflecting layer 80*c* which is transmitting to electron beam 7*a* such as of aluminum or other metal. The light sensitive film 81 may comprise emulsion layer such as of silver halide or other halides or may comprise a photoconductive layer such as of Se or $Sb_2S_3$ with activators such as Tellurium or Arsenic. The assembly of fluorescent film 80 and light sensitive film 81 is travelling across the tube 85 on a supporting member 78. The image producing means comprise, therefore, a flexible fluorescent film 80 mounted or deposited on the emulsion side of light sensitive flexible film 81. The fluorescent film 80 is flexible or semi-flexible and comprises a very thin flexible or semi-flexible supporting layer 80*a***, such as of aluminum oxide, silicon oxide or of light transparent and heat resistant plastics, such as polyamides, polycarbonates, or polyesters of the thickness not exceeding 60 microns.

The light sensitive film 81 is also flexible or semiflexible and comprises a flexible or semi-flexible supporting layer 82 of one of materials described above for the layer **80*a* and also comprises light sensitive emulsion layer 83 of silver and other halides. In some applications the supporting layer 82 may be light opaque. The fluorescent film 80 is deposited or mounted on the light sensitive film 81 either on its layer 82 or on the layer 83 if better resolution is necessary. The fluorescent film 80 and light sensitive film 81 are glued together by means of a suitable binder 81*a* at predetermined space intervals as shown on FIG. 4A, in order to prevent the slippage of the fluorescent film 80 in relation to light sensitive film 81. The binder can be easily removed after the exposure outside of the vacuum tube 85. In this way, the fluorescent film 80 may be used again with another roll of light sensitive film 81. The rest of the vacuum tube 85** is the same as described in other modifications of this invention.

It should be understood instead of film 81, a photoconductive film such as of Se or $Sb_2S_3$ with activators such as Tellurium or Arsenic may be used in some applications. The photoconductive film 64 must be, however, mounted on an electrically conducting layer, such as of a metal which may also serve as a supporting member, which may be flexible or rigid; or on layer of Nesa 63 supported by layer 62. The layer 64 may be precharged or post-charged as described above.

As was explained above, the focusing means for electron beam **7*a*** may be of electrostatic type or of magnetic type.

An important improvement of the embodiment shown above in FIG. 3 is illustrated in FIG. 4B. In this embodiment screen 50 described above has a new construction 51 and is made to extend to the sidewalls of vacuum tube 90 or to supporting members 91 which are attached to the sidewalls **90*a* of said tube 90. This construction of screen 51 allows to eliminate the membrane 18 or its modifications because the screen 51 will now separate completely vacuum of compartment A from vacuum of compartment B. The screen 51 may be of fiberoptic construction described above or of a thin light transparent layer of aluminum oxide or silicon oxide or of heat resistant plastics, such as polycarbonates, polyamides or silicones. The fluorescent layer 53 is of one of phosphors described above and is mounted on said screen 51 and is provided with light reflecting electron transmitting layer 54 such as of aluminum. It should be understood that this construction of screen 51** applies to all embodiments of this invention described herein which use image producing means of light sensitive type.

The image producing means must be light sensitive and may be of the type described herein such as 55 or 81 or their modifications. The image producing means travel from the outside of the vacuum tube 90 into compartment B of said tube and after the exposure travel to the outside of the tube 90 for processing, as was explained above.

As was explained above, focusing and demagnifying electrodes may be of magnetic or electromagnetic type in all embodiments of invention. The great weight of said electrodes is not a problem because the novel apparatus for electroradiography may be located under or behind the examining table and be stationary in all examinations. This embodiment of invention is shown in FIG. 5. In this embodiment, magnetic or electromagnetic electrodes 75 of demagnifying type focus the electron beam *7a* on the membrane 18 or its modifications and electrostatic electrodes 4 provide acceleration of said beam. The membrane 18 must be mounted on its support 18*b* and the size of the membrane 18 has to be larger than the size of demagnified electron beam *7a*. Magnetic focusing is capable of producing images of high resolution. It requires, however, for a high resolution a very flat surface of image producing means. This flatness can be insured by a supporting member 73 shown in FIG. 5 which operates by electrostatic attraction. For this purpose, the surface of image producing means described above has to be rendered electrically conducting such as by evaporating aluminum or other metal thereon. The supporting member 73 must be very flat and may be of electrically conducting metal or may be in the form of a flat dielectric plate within which an electrically conducting layer is sandwiched. The conducting layer of image producing means and the support 73 are connected to the source 74 of electrical potential such as of 1000 volt and when this circuit is closed the image producing means will be attracted to form a good contact with support 73. It should be understood that this construction may be used in all vacuum tubes described herein.

It should be understood that in some applications compartment B may be modified by forming windows such as 66 and 67 on its endwall instead of on sidewalls. This embodiment is shown in FIG. 6. Also the supply of film 8 or 25 or 35 or 70 and their modifications may be held in the compartment B on a reel 88 before the exposure to avoid continuous opening and closing of vacuum locks 17. Also the above films after their exposure may be held in the compartment B on a reel 89 to avoid continuous opening and closing of vacuum locks 17. In some applications compartment B may have only one window such as 66 instead of 2 windows. It should be understood that the above modifications of compartment B apply to all embodiments of invention.

It should be understood that travelling film such as 8, 25, 35, 55 or 81 and their modifications may be cooled before introduction into compartment B in order to prevent liberation of gasses.

It should be understood that in all modifications of this invention in which the image receiving and producing means are in the form of a stationary fluorescent screen mounted in the compartment B, the endwall of said compartment B may be of vacuum tube glass or it may be of fiberoptic construction for the whole or a part of the endwall.

It should be understood that this invention is applicable and useful also for vacuum tubes which use instead of the photocathode an electron gun. In such case the photocathode 3 or its modifications will be replaced by an electron gun. One important application of this invention is therefore the standard electron microscope.

In some cases the membrane 18 should be constructed of a supporting layer such as of aluminum oxide or silicon oxide which has on each of its major surfaces deposited an electrically conducting layer such as of aluminum or of silicon. One preferred method of constructing membrane 18 and all its modifications is to evaporate a layer of aluminum or silicon on a support of nitrocellulose and then to oxidize said layer to convert it into an oxide. Then, according to the application in which said membrane is used, another layer of aluminum or silicon may be evaporated on the layer of aluminum oxide or silicon oxide on one side thereof or on both sides.

The support of nitrocellulose will be destroyed by baking of the vacuum tube leaving a thin membrane 18 or its modifications.

It should be understood that the term membrane as used in specification and in the appended claims embraces all types of screens or layers.

It should be understood that the use of membrane 18 and all its modifications applies to all embodiments of invention. It should be also understood that the use of shutter 18 applies to all embodiments of invention. It should be understood that the use of supporting means 18*b* or of baffles of guards 4*a* applies to all embodiments of invention.

It should be understood that all vacuum tubes described above may be provided with windows or openings 66 and 67 in their walls, as described above.

It should be understood that the apparatus for feeding the film 8 or 25 or 35 or their modifications into a vacuum tube and the apparatus for receiving the above film transported to the outside of the vacuum tube, may be used in all embodiments of invention or, alternatively, may be omitted.

It should be understood that the fluorescent screen 40 may be used in all embodiments of the invention. In such case, supporting member 10 or 40 is eliminated.

It should be understood in all devices described above, the X-ray reactive photocathode 3 may be of composite screen type described above and illustrated in FIG. 1 or may be of a metal of high atomic number such as tungsten or lead or may be of a neutron-sensitive type as described in my U.S. Pat. No. 2,555,424.

It should be understood that in all devices described above the use may be made of amplification of the electron beam either by means of another stage composite screen, or of a multichannel electron multiplier or of transmission type of electron multiplier such as silicon membrane of p-type. It should be understood that in all devices described above the focusing means for electron beam may be of electrostatic type or of magnetic type or of proximity focusing type. It should be understood that an ion pump or titanium pump may be used in all embodiments of invention for the best gettering action, for both compartments A and B.

It should be understood that dielectric material described above means a material which has electrical resistivity not less than $10^{12}$ ohm-cm. It should be understood that in all embodiments of invention said means for receiving electron beam may be formed of a sheet or tape and may be flexible, semi-flexible or non-flexible.

It should be understood that in all embodiments of invention the final electroradiographic image may be made on a transparent substrate or on light reflecting substrate. It should be understood that in all embodiments of invention the final electroradiograph may be made of either polarity, which means that black and white areas of electroradiograph may be reversed according to the need of application. It should be understood that in all embodiments of invention the final electroradiograph may be produced on the original film which was used in a vacuum tube or may be produced on another medium which serves as a transfer medium.

It should be understood that the particular embodiments and forms of this invention have been illustrated and it is understood that modifications may be made by those skilled in the art without departing from the scope and spirit of the foregoing disclosure.

What I claim is:

1. A vacuum tube containing a first vacuum compartment and a second vacuum compartment, said first vacuum compartment comprising means for producing a beam of electrons, accelerating electrodes means for said electron beam, and an imperforate membrane mounted in the path of said electron beam, said membrane transmitting said accelerated beam of electrons and impervious to ions of energy below 25 KV, said membrane separating said first vacuum compartment from said second vacuum compartment, said second vacuum compartment comprising means for receiving said transmitted beam of electrons, producing electrical conductivity changes in response to said electron beam and producing an image corresponding to said electron beam, and window means for the passage of said image producing means into said second compartment and to the outside of said second compartment.

2. A device as defined in claim 1 in which said electrode means comprise an electrode for demagnifying said electron beam and in which said membrane is mounted on the aperture of said demagnifying electrode.

3. A device as defined in claim 2 in which said membrane is mounted outside of the aperture of said demagnifying electrode and in which said membrane is provided with supporting means.

4. A device as defined in claim 1 in which said membrane is mounted on inside walls of said accelerating electrode means.

5. A device as defined in claim 1 which comprises in combination means for introducing said image producing means into said second vacuum compartment and for transporting said image producing means from said second vacuum compartment to the outside of said tube.

6. A device as defined in claim 1 in which mechanical members attached to walls of said tube are provided in addition to close said first vacuum compartment and to separate from said second vacuum compartment.

7. A device as defined in claim 1 in which said second vacuum compartment comprises a fluorescent screen.

8. A device as defined in claim 1 in which said image producing means comprise a fluorescent layer and a photoconductive layer.

9. A device as defined in claim 1 in which said image producing means comprise fluorescent means and light sensitive means.

10. A device as defined in claim 1 in which mechanical members attached to sidewalls of said tube are provided in addition to close said first vacuum compartment and to separate from said second vacuum compartment.

11. A device as defined in claim 1 in which in addition mechanical means attached to said electrode means are provided to close said first vacuum compartment and to separate from said second vacuum compartment.

12. A device as defined in claim 1 in which said second vacuum compartment comprises shutter means which are adapted for opening for the passage of said beam of electrons transmitted through said membrane.

13. A device as defined in claim 1 in which said image producing means comprise a fluorescent layer and a photoconductive layer.

14. A device as defined in claim 1 in which said second vacuum compartment comprises a fluorescent screen.

15. A vacuum tube containing a first vacuum compartment and a second vacuum compartment, said first vacuum compartment comprising means for producing a beam of electrons, accelerating electrode means for said electron beam and an imperforate membrane mounted in the path of said electron beam, said membrane transmitting said accelerated beam of electrons and impervious to ions of energy below 25 KV, said membrane separating said first vacuum compartment from said second vacuum compartment, said second vacuum compartment comprising means for receiving said transmitted beam of electrons and producing an image corresponding to said electron beam, said image producing means being insensitive to light and of high electrical resistivity.

16. A device as defined in claim 15 in which said electrodes means comprise an electrode for demagnifying said electron beam and in which said membrane is mounted on the aperture of said demagnifying electrode and is closing said aperture.

17. A device as defined in claim 15, in which said membrane is mounted outside of the aperture of said demagnifying electrode and in which said membrane is provided with supporting means.

18. A device as defined in claim 15, in which said membrane is mounted on inside walls of said accelerating means.

19. A device ad defined in claim 15 in which said membrane comprises a layer of dielectric material and a layer of electrically conducting material.

20. A device as defined in claim 15 in which membrane consists only of dielectric material.

* * * * *